US008789913B2

(12) United States Patent
Maeda

(10) Patent No.: US 8,789,913 B2
(45) Date of Patent: Jul. 29, 2014

(54) PRINTING APPARATUS

(75) Inventor: Toshio Maeda, Kyoto (JP)

(73) Assignee: Dainippon Screen Mfg. Co., Ltd. (JP)

( * ) Notice: Subject to any disclaimer, the term of this patent is extended or adjusted under 35 U.S.C. 154(b) by 166 days.

(21) Appl. No.: 13/393,108

(22) PCT Filed: Jun. 25, 2010

(86) PCT No.: PCT/JP2010/060839

§ 371 (c)(1),
(2), (4) Date: Feb. 28, 2012

(87) PCT Pub. No.: WO2011/040099

PCT Pub. Date: Apr. 7, 2011

(65) Prior Publication Data

US 2012/0154478 A1 Jun. 21, 2012

(30) Foreign Application Priority Data

Sep. 29, 2009 (JP) ..... 2009-223671

(51) Int. Cl.
*B41J 29/393* (2006.01)
*B41J 29/38* (2006.01)

(52) U.S. Cl.
USPC ..... 347/19; 347/5

(58) Field of Classification Search
USPC ..... 347/19, 5
See application file for complete search history.

(56) References Cited

U.S. PATENT DOCUMENTS 6,000,776 A * 12/1999 Suzuki et al. ..... 347/19
6,106,094 A * 8/2000 Otani et al. ..... 347/19
6,335,978 B1 * 1/2002 Moscato et al. ..... 382/112
6,804,479 B2 * 10/2004 Kimura ..... 399/49
7,081,976 B2 * 7/2006 Harrington ..... 358/504
7,436,549 B2 * 10/2008 Venable et al. ..... 358/1.9
8,433,232 B2 * 4/2013 Fujii ..... 399/384

FOREIGN PATENT DOCUMENTS

JP 7-314844 12/1995
JP 09216440 A * 8/1997 ..... B41J 29/46
JP 9-240120 9/1997
JP 11-254793 9/1999
JP 11254795 A * 9/1999 ..... B41J 29/46
JP 2001-58446 3/2001
JP 2003011336 A * 1/2003 ..... B41J 2/01
JP 2003054095 A * 2/2003 ..... B41J 29/46

(Continued)

OTHER PUBLICATIONS

International Preliminary Report on Patentability issued in connection with corresponding PCT/JP2010/060839 and the English language translation.

*Primary Examiner* — Alessandro Amari
*Assistant Examiner* — Jeremy Bishop
(74) *Attorney, Agent, or Firm* — Ostrolenk Faber LLP

(57) ABSTRACT

A color inkjet printing apparatus in which an image capturing part captures an image of a page identifier printed on each page of a printing medium, and an inspection part compares a page identification result acquired from an output of the image capturing part with page identification information included in print data. The page identifier includes single-color parts that are each printed with only one of a plurality of colors used in the printing apparatus. Thus, a printing defect can be quickly detected during inspection of the first page in which the printing defect has occurred, irrespective of the ink color in which the printing defect has occurred.

16 Claims, 6 Drawing Sheets

(56) References Cited

FOREIGN PATENT DOCUMENTS

| | | | | | |
|---|---|---|---|---|---|
| JP | 2003054096 | A | * | 2/2003 | ..... B41J 29/46 |
| JP | 2003305927 | A | * | 10/2003 | ..... B41J 29/46 |
| JP | 2004-314610 | | | 11/2004 | |
| JP | 2005-125633 | | | 5/2005 | |
| JP | 2007-50513 | | | 3/2007 | |
| JP | 2007-127963 | | | 5/2007 | |
| JP | 2007-221552 | | | 8/2007 | |

* cited by examiner

| Shape of single-color part | Numerical value by single-color part |
|---|---|
|  | 0 |
|  | 1 |
|  | 2 |
|  | 3 |
|  | 4 |
|  | 5 |
|  | 6 |
|  | 7 |
|  | 8 |
|  | 9 |

PRINTING APPARATUS

CROSS REFERENCE TO RELATED APPLICATIONS

The present application is a 35 U.S.C. §371 national phase conversion of PCT/JP2010/060839 filed Jun. 25, 2010 and claims priority of JP2009-223671 filed Sep. 29, 2009, both incorporated herein in their entirety.

TECHNICAL FIELD

The present invention relates to a printing apparatus.

BACKGROUND ART

Conventionally, there have been used inkjet printing apparatuses that perform printing on a printing medium by scanning, relative to the printing medium, an ejection mechanism in which a plurality of outlets for ejecting minute ink droplets are arranged. In recent years, inkjet printing apparatuses have also been used for printing where the content to be printed varies for each page (so-called variable data printing) such as in credit card bills or the like, in which case, for example, printing is continuously performed on both the front and back surfaces of a plurality of pages set for a long-length printing medium.

Along with such printing apparatuses, various techniques for inspecting a printing defect where the content printed on the front surface of a page does not correspond to the content printed on the back surface of that page (i.e., the content to be printed on the back surface of one page is printed on the back surface of a different page) have been proposed. For example, Japanese Patent Application Laid-Open Gazette No. 2001-58446 discloses a technique for use in an inkjet printer that performs color printing on both the front and back surfaces of a long-length printing medium, in which an identifier such as a number, a symbol, or a bar code is printed on the front and back surfaces of each page, and a printing defect where the contents printed on the front and back do not correspond to each other is inspected by capturing and comparing images of the identifiers on both the front and back surfaces on the downstream side of the conveyance direction of the printing medium.

Meanwhile, like Japanese Patent Application Laid-Open Gazette No. 2001-58446, Japanese Patent Application Laid-Open Gazette No. 2004-314610 discloses a technique for use in an electrophotographic printing apparatus, in which a printing defect where the contents printed on the front and back do not correspond to each other is detected by printing a bar code or the like on both the front and back surfaces of a printing medium and capturing and comparing images of the bar code or the like on the downstream side. The printing apparatus disclosed in Japanese Patent Application Laid-Open Gazette No. 2004-314610 also enables detection of a printing defect where the front and back surfaces of a certain page are both missing, by comparing the bar codes on the front surfaces of adjacent pages and also comparing the bar codes on the back surfaces of these pages.

Incidentally, with the printing apparatuses as disclosed in Japanese Patent Application Laid-Open Gazettes Nos. 2001-58446 and 2004-314610, the bar codes on the front and back of each page are printed with a black (K) ink that can be read by an ordinary bar code reader. Therefore, a printing apparatus that performs color printing cannot detect printing defects due to inks of colors other than black even if such printing defects have occurred.

SUMMARY OF INVENTION

The present invention is intended for a printing apparatus, and it is an object of the present invention to detect printing defects due to inks of all colors in inkjet color printing.

The printing apparatus includes a printing mechanism by which printing is performed on a printing medium with inks of a plurality of colors using an inkjet system, a print control part that, when each page of the printing medium is printed, prints a page identifier on the printing medium based on page identification information included in print data of the page, by controlling the printing mechanism, an image pickup part that captures an image of the page identifier, and an inspection part that detects a printing defect by acquiring a page identification result from an output of the image pickup part and comparing the page identification result with the page identification information, wherein the page identifier includes at least one single-color part that is printed with only any one of the plurality of colors, and under control of the print control part, printing of single-color parts with all of the plurality of colors is performed during a period in which printing is being performed on only a predetermined number of pages. According to the present invention, it is possible to detect printing defects due to inks of all colors in inkjet color printing.

In a preferred embodiment of the present invention, the page identifier on each of the pages includes single-color parts printed with all of the plurality of colors. This enables quick detection of a printing defect. More preferably, the inspection part acquires a page identification result from each of the single-color parts printed with the plurality of colors and compares each of the page identification results with the page identification information. As a result, the color of an ink with which a printing defect has occurred can be easily specified.

In another preferred embodiment of the present invention, the page identifier on each of the pages is printed with only any one of the plurality of colors. Accordingly, the color of an ink with which a printing defect has occurred can be easily specified. More preferably, a color of the page identifier is sequentially changed for each page. This enables quick detection of a printing defect.

In still another embodiment of the present invention, the page identifier on each of the pages is a bar code. Accordingly, the page identification result can be easily acquired.

In still another embodiment of the present invention, the printing mechanism performs printing on both sides of the printing medium, in which case the page identifier is printed on both of the sides, the image pickup part captures images of the page identifiers on both of the sides, and the inspection part inspects consistency in printing between both of the sides by acquiring page identification results for both of the sides from an output of the image pickup part.

In still another embodiment of the present invention, the printing mechanism includes a supply part that holds a roll of unprinted printing medium and lets the printing medium out from the roll, and a taking-up part that takes up a portion of the printing medium that has undergone printing.

These and other objects, features, aspects and advantages of the present invention will become more apparent from the following detailed description of the present invention when taken in conjunction with the accompanying drawings.

MODE FOR CARRYING OUT THE INVENTION

Figure 1:
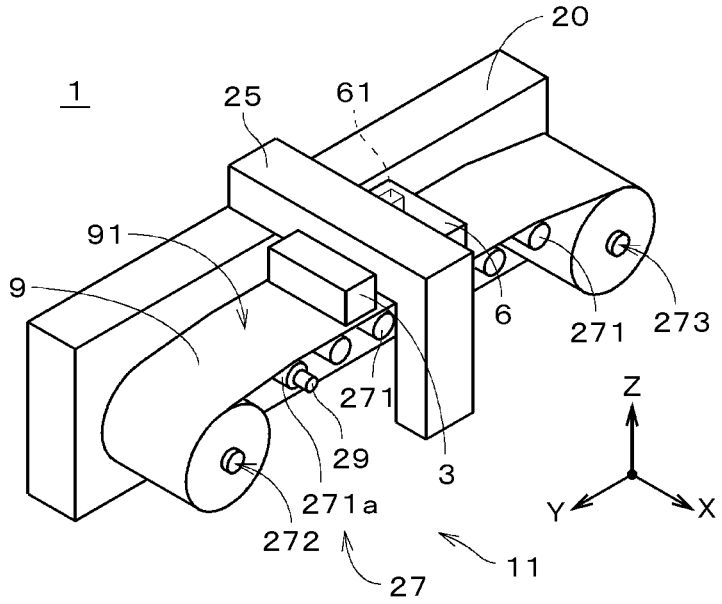
FIG. 1 is a perspective view showing an external appearance of a printing apparatus according to a first embodiment.

FIG. 1 is a perspective view showing an external appearance of a printing apparatus 1 according to a first embodiment of the present invention. The printing apparatus 1 is an apparatus that performs inkjet color printing on a printing medium 9, which is printing paper of long length. The printing apparatus 1 includes a printing mechanism 11 for performing printing on a main surface 91 (hereinafter referred to as a "front surface 91") of the printing medium 9 on the (+Z) side with inks of a plurality of colors, an image capturing part 6 that captures an image of a portion of the printing medium 9 that has undergone printing, and a control unit that controls these mechanisms.

The printing mechanism 11 includes a scanning mechanism 27 for moving the printing medium 9 in the Y direction (hereinafter also referred to as the "scanning direction") in FIG. 1, and an ejection unit 3 that ejects minute ink droplets toward the printing medium 9 that is being conveyed by the scanning mechanism 27. The ejection unit 3 and the image capturing part 6 are disposed above the scanning mechanism 27 (on the (+Z) side) and fixed to a frame 25 that is provided on a base 20 so as to span over the scanning mechanism 27.

In the scanning mechanism 27, a plurality of rollers 271 that are each long in the X direction (i.e., the direction that is horizontal and is perpendicular to the Y direction) in FIG. 1 are arranged in the Y direction, a supply part 272 that holds a roll (supply roll) of unprinted printing medium 9 is provided on the (+Y) side of the plurality of rollers 271, and a taking-up part 273 that holds a roll (taking-up roll) of printing medium 9 is provided on the (−Y) side of the plurality of rollers 271. In the following description, it is assumed that the printing medium 9 as simply referred to means the printing medium 9 that is being conveyed (that is, the printing medium 9 on the plurality of rollers 271).

An encoder 29 that detects the moving speed of the printing medium 9 in the scanning direction is provided in one roller 271*a* of the scanning mechanism 27. By a later-described scanning controller 412 (see FIG. 3) controlling motor rotation of the taking-up part 273 based on the output of the encoder 29, a portion of the printing medium 9 that has undergone printing is taken up by the taking-up part 273, and at the same time, the printing medium 9 is let out from the supply roll in the supply part 272 and moves at a constant speed in the (−Y) direction. At this time, the printing medium 9 smoothly moves on the plurality of rollers 271 without waving, by a load (tension) being applied to the printing medium 9 in the direction ((+Y) direction) opposite to the movement direction by a motor of the supply part 272.

Figure 2:
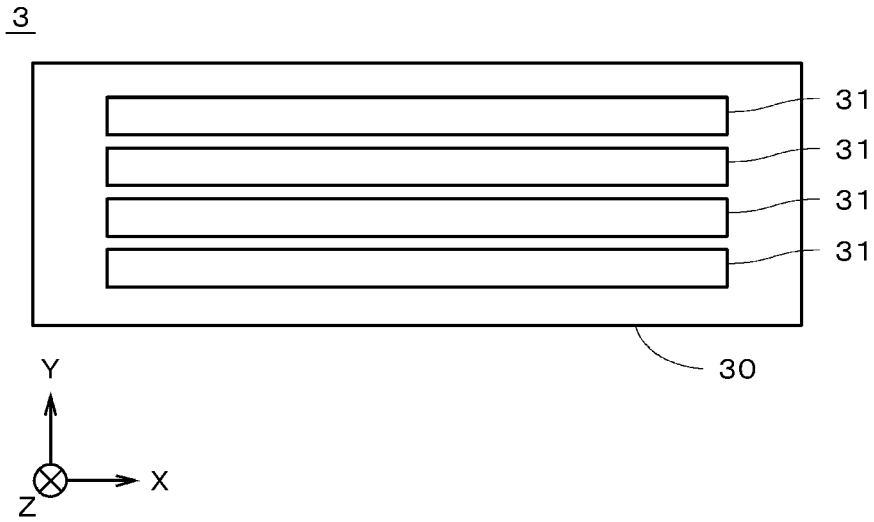
FIG. 2 is a bottom view of an ejection unit.

FIG. 2 is a bottom view showing the ejection unit 3. The ejection unit 3 includes inkjet heads 31 that are a plurality of (in the present embodiment, four) heads each ejecting an ink of a different color, and these inkjet heads 31 have the same configuration. The plurality of inkjet heads 31 are arranged in the Y direction (i.e., the scanning direction) and attached to an attachment part 30 of the ejection unit 3.

In FIG. 2, the inkjet head 31 located closest to the (+Y) side ejects an ink of black (K) color, the inkjet head 31 located on the (−Y) side of the black inkjet head 31 ejects an ink of cyan (C) color, the inkjet head 31 located on the (−Y) side of the cyan inkjet head 31 ejects an ink of magenta (M) color, and the inkjet head 31 located closest to the (−Y) side ejects an ink of yellow (Y) color. Note that the ejection unit 3 may also be provided with inkjet heads or the like for other colors such as light cyan, light magenta, or white.

As shown in FIG. 1, the image capturing part 6 is provided with a two-dimensional charge coupled device (CCD) camera 61 including a plurality of CCD elements. The two-dimensional CCD camera 61 is disposed on the (−Y) side of the ejection unit 3, which is the downstream side in the conveyance direction of the printing medium 9, and captures an image of a part of the front surface 91 of the printing medium 9 that has undergone printing and is passing through under the camera.

In the printing apparatus 1, each inkjet head 31 (see FIG. 2) is provided extending over the entire printing area of the printing medium 9 in the X direction (here, extending across the entire width of the printing medium 9 in the X direction), and printing of an image on the printing medium 9 is completed through a single operation of the scanning mechanism 27 moving the printing medium 9 relative to the ejection unit 3 in the scanning direction (i.e., by a single pass of the printing medium 9, which is moving in the (−Y) direction, under the ejection unit 3) (so-called single-pass printing is performed).

Figure 3:
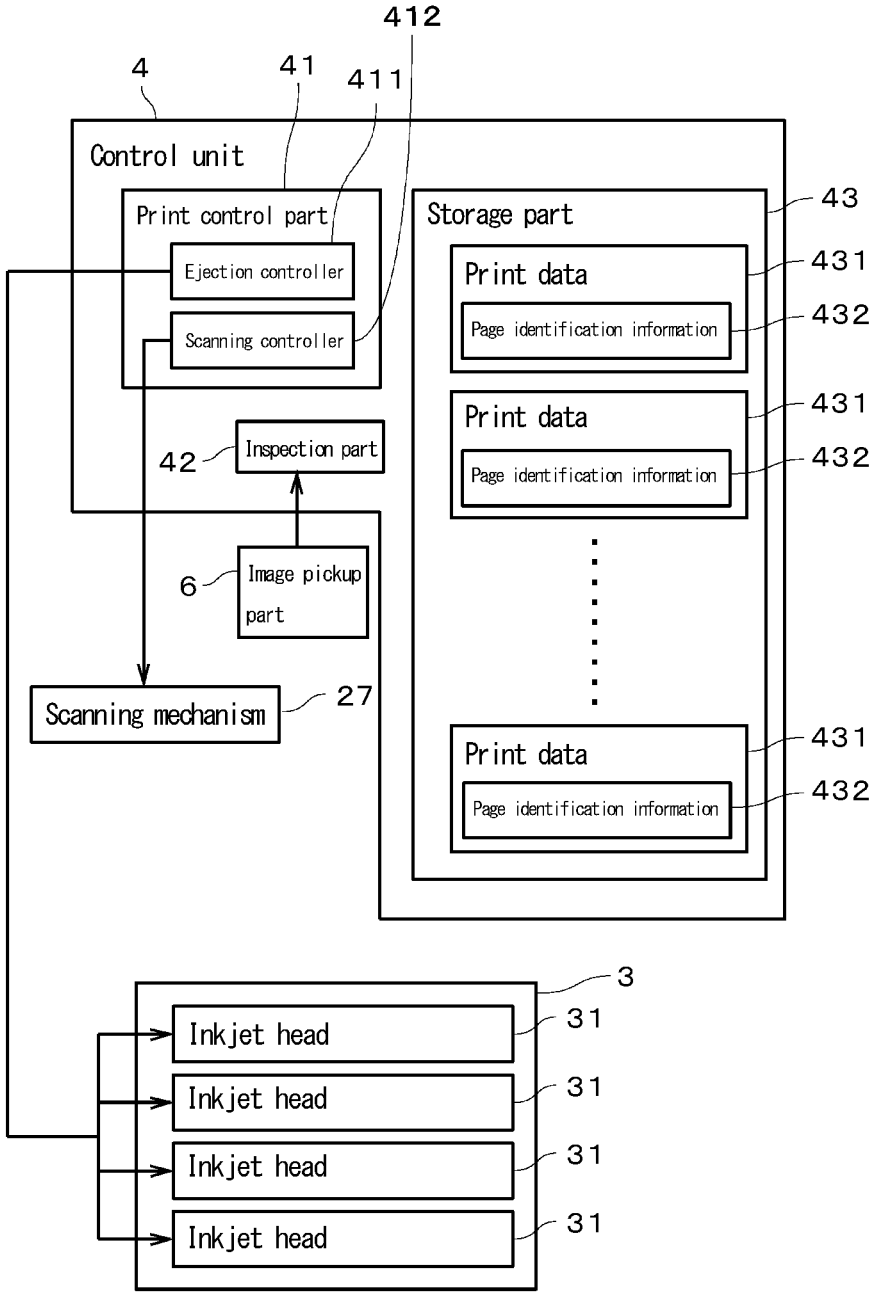
FIG. 3 is a block diagram showing the functions of a control unit.

FIG. 3 is a block diagram showing the functions of a control unit 4. In FIG. 3, a part of the configuration of the printing apparatus 1 connected to the control unit 4 is shown together. The control unit 4 includes a print control part 41 that controls the printing mechanism 11, an inspection part 42 that detects a printing defect on the printing medium 9, and a storage part 43 that stores various types of information. The print control part 41 includes an ejection controller 411 that controls ejection of inks from the four inkjet heads 3 of the ejection unit 3, and the scanning controller 412 that performs control of the scanning mechanism 27.

Figure 4:
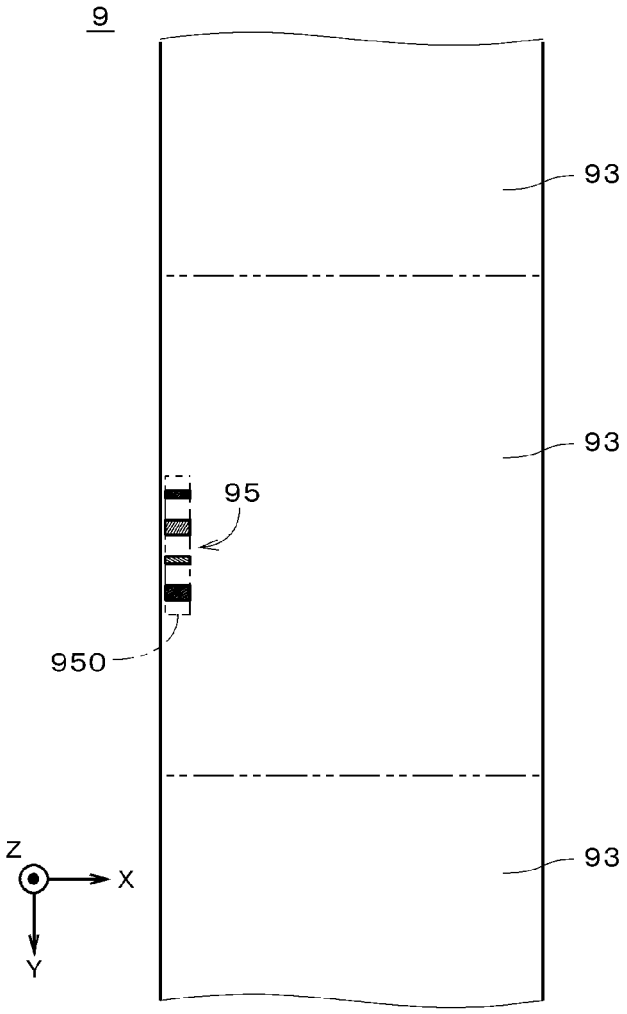
FIG. 4 is a plan view of a printing medium.

As shown in FIG. 4, a plurality of pages 93 that are arranged in the scanning direction and on which images are to be printed are set for the printing medium 9. The printing apparatus 1 performs variable data printing in which a different image is to be printed on the front surface 91 of the printing medium 9 for each page 93. In FIG. 4, the border between each pair of adjacent pages 93 is indicated by the chain double-dashed line. The storage part 43 shown in FIG. 3 stores a plurality of print data pieces 431 that correspond respectively to images to be printed on the plurality of pages 93 of the printing medium 9. The print data 431 of each page includes page identification information 432 for identifying the page from other pages (e.g., information indicating the page number of the current page).

In the printing apparatus 1 shown in FIG. 1, printing onto the printing medium 9 is performed by the print control part 41 controlling the scanning mechanism 27 and the ejection unit 3 based on the plurality of print data pieces 431 (see FIG. 3) so that inks are ejected from the ejection unit 3 toward the printing medium 9 in synchronization with the movement of the printing medium 9 relative to the ejection unit 3 in the scanning direction. When printing is performed on each page 93 of the printing medium 9 shown in FIG. 4, a page identifier 95 is printed in an identifier printing area 950 set in one edge portion of the page 93 in the width direction (in the present embodiment, the edge portion on the (−X) side), based on the page identification information 432 included in the print data 431 of the page. Although the identifier printing area 950 is indicated by the chain double-dashed line in FIG. 4 in order to facilitate understanding of the figure, the rectangle indicated by the chain double-dashed line is in actuality not printed (the same applies to FIGS. 5, 7, and 8).

The identifier printing area 950 is set, for example, outside punching holes that are formed in opposite sides of the printing medium 9 in the X direction for use in conveyance of the printing medium 9 or the like. Also, marks or the like indicating, for example, a page break and a print start position are printed upstream and downstream of the identifier printing area 950 (on the (−Y) and (+Y) sides). The aforementioned punching holes or other marks or the like are not shown in FIG. 4.

Figure 5:
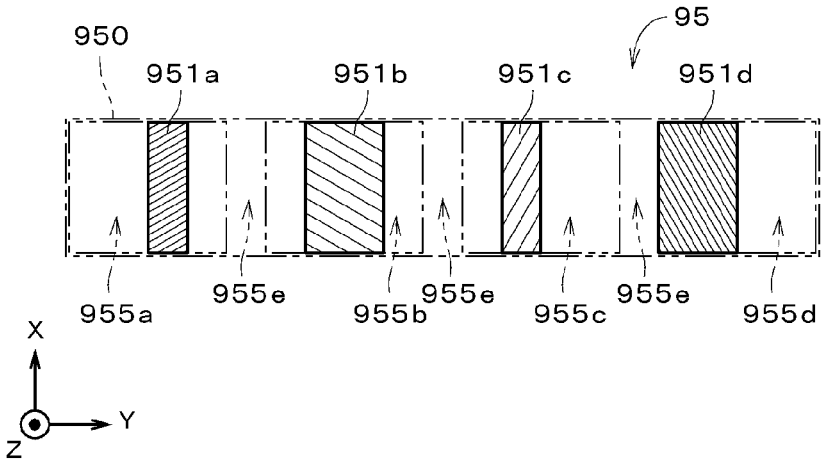
FIG. 5 is an enlarged plan view of a page identifier.

FIG. 5 is an enlarged plan view of a page identifier 95. In FIG. 5, the Y direction drawn parallel to the longitudinal direction in FIG. 4 has been drawn parallel to the lateral direction. The page identifier 95 includes a single-color part (unicolor part) 951*a* printed with only an ink of K color, a single-color part 951*b* printed with only an ink of C color, a single-color part 951*c* printed with only an ink of M color, and a single-color part 951*d* printed with only an ink of Y color. In other words, the page identifier 95 includes the single-color parts 951*a* to 951*d* printed with all of the plurality of (in the present embodiment, four) colors used for printing in the printing apparatus 1.

The single-color parts 951*a* to 951*d* are printed respectively in four single-color-part printing areas 955*a* to 955*d* that are arranged in the Y direction within the identifier printing area 950, and a blank area 955*e* (i.e., an area on which printing is not performed) is provided between each pair of adjacent single-color-part printing areas. The single-color parts 951*a* to 951*d* each represent one of single-digit integers from "0" to "9" depending on the shape. Although the single-color-part printing areas 955*a* to 955*d* are each encircled by the chain double-dashed line in FIG. 5 in order to facilitate understanding of the figure, these rectangles indicated by the chain double-dashed lines are in actuality not printed (the same applies to FIG. 8).

Figure 6:
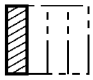
FIG. 6 is a diagram showing the relationship between the shape of single-color parts and the numerical values represented by the single-color parts.
Figure 6:
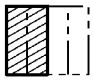
Figure 6:
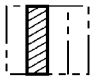
Figure 6:
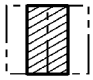
Figure 6:
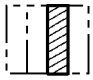
Figure 6:
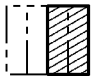
Figure 6:
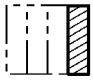
Figure 6:
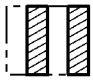
Figure 6:
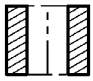
Figure 6:
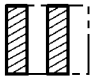

FIG. 6 is a diagram showing the relationship between the shapes of the single-color parts and the numerical values represented by the single-color parts. As shown in FIG. 6, if only the leftmost area (which corresponds to the (−Y) side on the printing medium 9) is colored out of four areas obtained by dividing one single-color-part printing area into four in the Y direction, the single-color part represents "0". If the two leftmost areas are colored, the single-color part 951 represents "1", and if only the second area from the left is colored, the single-color part 951 represents "2".

The single-color part 951 represents "3" if the second and third areas from the left are colored, and represents "4" if only the third area from the left is colored. If the two rightmost areas of the single-color-part printing area 955 are colored, the single-color part 951 represents "5", and if only the rightmost area is colored, the single-color part 951 represents "6". Furthermore, the single-color part represents "7" if the second area from the left and the rightmost area are colored, represents "8" if the leftmost area and the rightmost area are colored, and represents "9" if the leftmost area and the third area from the left are colored.

In the printing apparatus 1 shown in FIG. 1, in parallel with the printing performed on the printing medium 9, the image capturing part 6 captures an image of the page identifier 95 (see FIG. 5) printed in the identifier printing area 950 on each page. An output from the image capturing part 6 is transmitted to the inspection part 42 of the control unit 4 (see FIG. 3), and the inspection part 42 acquires a page identification result from the output of the image capturing part 6. At this time, the inspection part 42 acquires the page identification result from each of the single-color parts 951*a* to 951*d* of the page identifier 95 whose image has been captured by the image capturing part 6. In the present embodiment, values of "4", "3", "2" and "1" are acquired as the numerical values represented respectively by the single-color parts 951*a* to 951*d*, and it can thereby be seen that the imaged page is the 1234th page. Then, each of the identification results is compared with the page identification information 432 included in the print data 431 (see FIG. 3), and a printing defect is detected if the page identification result and the page identification information 432 are different.

The following describes a specific embodiment of detecting a printing defect, taking an ink of K color as an example. Note that the following description also applies to inks of the other colors. If data to be printed on a different page with an ink of K color has been printed on the current page due to a missing page or the like, a printing defect due to the ink of K color is detected because the page identification result acquired from the black single-color part 951*a* of the page identifier 95 differs from the page identification information 432.

Furthermore, with the print data 431 corresponding to a single page of the printing medium 9, if the result of printing with the ink of K color has shifted in the Y direction due to, for example, a loss of part of data to be printed on that page with the ink of K color, the black single-color part 951*a* is printed at a position shifted in the Y direction from the identifier printing area 950. As a result, a printing defect due to the ink of K color is detected because the image of the single-color part 951*a* cannot be appropriately captured by the image capturing part 6 and accordingly the page identification result acquired from the single-color part 951*a* differs from the page identification information 432.

If all the data to be printed with the ink of K color has been lost or if printing using the ink of K color has not been performed due to, for example, the occurrence of an ejection failure in the inkjet head 31 for ejecting the ink of K color, a printing defect due to the ink of K color is detected because the black single-color part 951*a* is not printed and accordingly the page identification result corresponding to the single-color part 951*a* cannot be acquired.

As described above, in the printing apparatus 1, the image of the page identifier 95 printed on each page of the printing medium 9 is captured by the image capturing part 6, and the page identification results obtained from the output of the image capturing part 6 and the page identification information 432 included in the print data 431 are compared in the inspection part 42. Since the page identifier 95 includes the single-color parts 951*a* to 951*d* printed with inks of all of the plurality of colors used in the printing apparatus 1, a printing defect can be quickly detected during inspection of the first page in which the printing defect has occurred, irrespective of with which ink color out of the plurality of colors the printing defect has occurred. Furthermore, the color of an ink with which a printing defect has occurred can be easily specified by the inspection part 42 acquiring the page identification result from each of the single-color parts 951*a* to 951*d* of the page identifier 95 and comparing each of the page identification results with the page identification information 432.

With the printing apparatus 1, it is also possible, by changing the control performed by the print control part 41, to print the entire page identifier on each page of the printing medium 9 with only an ink of one of the plurality of colors used in the printing apparatus 1 and to perform printing of page identifiers with inks of all of the plurality of colors during the period in which printing is being performed for a predetermined number of pages (which is the number of pages greater than or equal to the number of ink colors (in the present embodiment, four) used in the printing apparatus 1, and is hereinafter referred to as a "unit page number"). In other words, the page identifier forms one single-color part, and under the control of the print control part 41, printing of single-color parts with all of the above plurality of colors is performed during the period in which printing is being performed for the unit page number.

For example, in the case where the unit page number is four, a page identifier is printed with the ink of K color in the identifier printing area 950 (see FIG. 4) on the first page, a page identifier is printed with the ink of C color in the identifier printing area 950 on the second page, a page identifier is printed with the ink of M color in the identifier printing area 950 on the third page, and a page identifier is printed with the ink of Y color in the identifier printing area 950 on the fourth page. As for the fifth and subsequent pages, the color of the page identifier is changed for each page in order starting with K, then to C, to M, and to Y.

Figure 7:
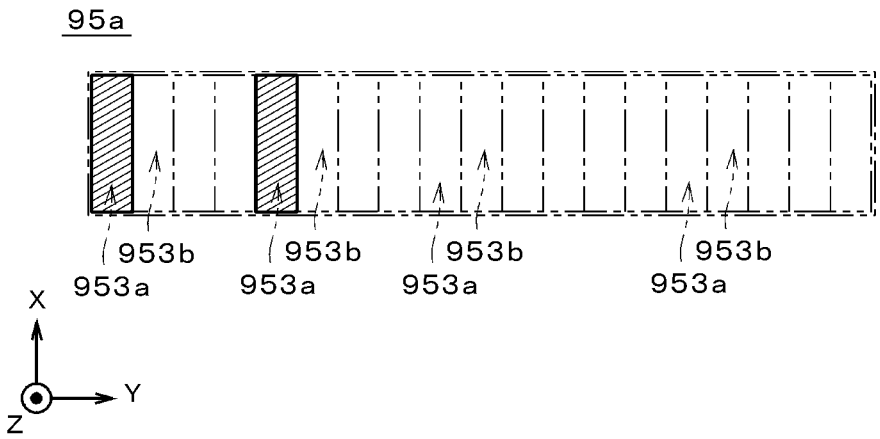
FIG. 7 is an enlarged plan view of another page identifier.

FIG. 7 is a view showing another page identifier 95*a* having a different relationship between the shape and the numerical value from that of the page identifier 95 shown in FIG. 5. In the example shown in FIG. 7, an identifier printing area 950 in which the page identifier 95*a* is to be printed includes a plurality of color areas 953*a* and a plurality of blank areas 953*b* that are alternately arranged in the Y direction, and the plurality of color areas 953*a* arranged in the (+Y) direction from the (−Y) side correspond respectively to a plurality of binary digits from the lowest to the highest. A colored color area 953*a* represents a corresponding binary-digit value of "1", and a non-colored color area 953*a* represents a corresponding binary-digit value of "0". Accordingly, the page identifier 95*a* shown in FIG. 7 indicates the fifth page.

In the printing apparatus 1 shown in FIG. 1, as described above, the image capturing part 6 captures the image of the page identifier 95*a* (see FIG. 7) on each page, and the inspection part 42 acquires a page identification result from the output of the image capturing part 6 and compares the page identification result with the page identification information 432 (see FIG. 3) in the print data 431. Then, if a mismatch between the page identification result and the page identification information 432 has been detected on a certain page, a printing defect on that page is detected, and at the same time, the printing defect is determined to have occurred with the ink color used to print the page identifier 95*a* on that page. In this way, the color of an ink with which a printing defect has occurred can be easily specified by printing the page identifier 95*a* on each page with an ink of any one of the plurality of colors used in the printing apparatus 1.

Incidentally, with the method for printing the page identifier 95*a* on each page with only an ink of a single color, for example, if the color of the page identifier 95*a* is assumed to be changed for each page in order starting with K from the first page, then to C, then to M, and then to Y and a printing defect due to the ink of K color has occurred on the second page, that printing defect cannot be detected until the end of inspection of the fifth page on which the page identifier 95*a* is next printed with the ink of K color. Accordingly, from the viewpoint of reducing the time from the occurrence of a printing defect to the detection of the printing defect as short as possible, the interval between pages on which the page identifier 95*a* is printed with an ink of the same color is preferably as short as possible.

As described above, the printing apparatus 1 can relatively quickly detect a printing defect by sequentially changing the color of the page identifier 95*a* for each page on condition that the unit page number is made equal to the number of ink colors (in the present embodiment, four) used in the printing apparatus 1.

Figure 8:
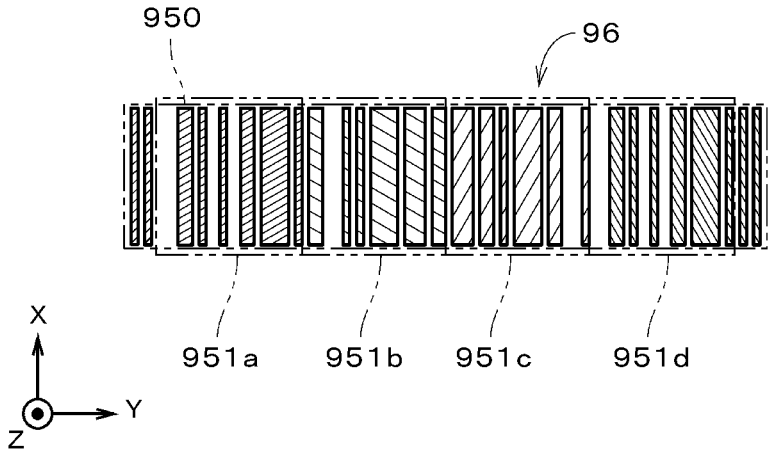
FIG. 8 is an enlarged plan view of a bar code according to a second embodiment.

Next is a description of a printing apparatus according to a second embodiment of the present invention. The printing apparatus according to the second embodiment has the same configuration as that of the printing apparatus 1 shown in FIG. 1, with the exceptions that a bar code 96 shown in FIG. 8 is printed, instead of the page identifier 95 shown in FIG. 5, as the page identifier in the identifier printing area 950 on each page of the printing medium 9, and that a bar code reader is provided, instead of the two-dimensional CCD camera 61, in the image capturing part 6 shown in FIG. 1. In the following description, the same reference numerals have been given to constituent elements of the printing apparatus according to the second embodiment that correspond to those of the printing apparatus 1 shown in FIG. 1.

In the printing apparatus according to the second embodiment, the bar code reader of the image capturing part 6 captures an image of the bar code 96 printed on each page of the printing medium 9, and the inspection part 42 (see FIG. 3) compares the page identification result acquired from the output of the image capturing part 6 (i.e., the result of readout by the bar code reader) with the page identification information 432 included in the print data 431 (see FIG. 3). Since the bar code 96 includes single-color parts 951*a* to 951*d* printed with all of the plurality of colors (in the present embodiment, four) used in the printing apparatus 1 as shown in FIG. 8, a printing defect can be quickly detected during inspection of the first page in which the printing defect has occurred, irrespective of with which ink color out of the plurality of colors the printing defect has occurred, as in the first embodiment. Although the single-color parts 951*a* to 951*d* are encircled by the chain double-dashed lines in FIG. 8 in order to facilitate understanding of the figure, these rectangles indicated by the chain double-dashed lines are in actuality not printed.

Also, as in the first embodiment, the color of an ink with which a printing defect has occurred can be easily specified by the inspection part 42 acquiring a page identification result from each of the single-color parts 951*a* to 951*d* of the bar code 96 and comparing each of the page identification results with the page identification information 432. Furthermore, using the bar code 96 as the page identifier facilitates acquisition of the page identification results from the page identifier, using an existing bar code reader.

With the printing apparatus according to the second embodiment, as in the first embodiment, it is also possible, by changing the control performed by the print control part 41, to print the entire bar code 96 on each page of the printing medium 9 with only an ink of any one of K, C, M, and Y colors and to perform printing of bar codes 96 with inks of all K, C, M, and Y colors during the period in which printing is being performed for the unit page number. In other words, the bar code 96 forms one single-color part, and under the control of the print control part 41, printing of the single-color parts with all of the above plurality of colors is performed during the period in which printing is being performed for the unit page number.

With the printing apparatus according to the second embodiment, as in the first embodiment, the color of an ink with which a printing defect has occurred can be easily specified even if the bar code 96 on each page is printed with only an ink of a single color out of inks of the plurality of colors used in the printing apparatus. Furthermore, as in the first embodiment, a printing defect can be relatively quickly detected by sequentially changing the color of the bar code 96 for each page on condition that the unit page number is made equal to the number of ink colors (in the present embodiment, four) used in the printing apparatus.

Figure 9:
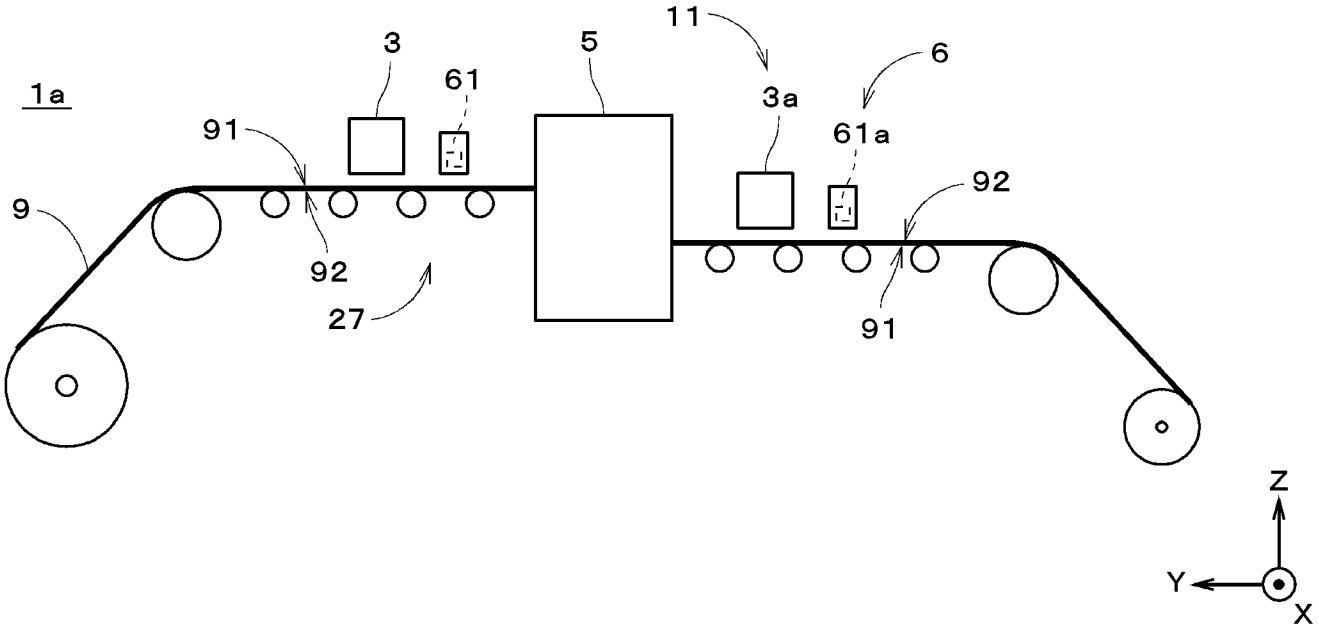
FIG. 9 is a front view showing the configuration of a printing apparatus according to a third embodiment

Next is a description of a printing apparatus according to a third embodiment of the present invention. FIG. 9 is a front view showing the configuration of a printing apparatus 1*a* according to the third embodiment. In the printing apparatus 1*a*, an inversion mechanism 5 for inverting the front surface 91 and a back surface 92 of the printing medium 9 is provided on a conveyance path of the printing medium 9. Also, the printing mechanism 11 further includes another ejection unit 3*a* disposed on the (−Y) side of the inversion mechanism 5, facing the back surface 92 of the printing medium 9, and the image capturing part 6 includes another two-dimensional CCD camera 61*a* disposed on the (−Y) side of the ejection unit 3*a*. The other constituent elements are the same as those of the printing apparatus 1 shown in FIG. 1, and in the following description, the same reference numerals have been given to constituent elements of the printing apparatus 1*a* that correspond to those of the printing apparatus 1.

In the printing apparatus 1*a*, the ejection unit 3 ejects minute ink droplets toward the front surface 91 of the printing medium 9, and the two-dimensional CCD camera 61 of the image capturing part 6 sequentially captures images of the identifier printing areas 950 (see FIG. 4) of a plurality of pages set for the front surface 91 of the printing medium 9. Then, the inversion mechanism 5 inverts the front surface 91 and the back surface 92 of the printing medium 9 such that the back surface 92 is on the (+Z) side, and the ejection unit 3*a* ejects minute ink droplets toward the back surface 92 of the printing medium 9 in synchronization with the movement of the printing medium 9 in the scanning direction. In the printing apparatus 1*a*, the printing mechanism 11 (i.e., the ejection unit 3, the ejection unit 3*a*, and the scanning mechanism 27) performs printing on the front surface 91 and the back surface 92 of each page of the printing medium 9, and the page identifier 95 (see FIG. 5) including the single-color parts 951*a* to 951*d* printed with inks of all of the plurality of colors used in the printing apparatus 1*a* (in the present embodiment, inks of four colors including K, C, M, and Y) is also printed on both sides of each page of the printing medium 9.

The two-dimensional CCD camera 61*a* of the image capturing part 6 sequentially captures images of the identifier printing areas 950 (see FIG. 4) of a plurality of pages set for the back surface 92 of the printing medium 9 that is passing through under the camera. In the printing apparatus 1*a*, the two-dimensional CCD cameras 61 and 61*a* of the image capturing part 6 capture images of the page identifiers 95 on both sides (i.e., the front surface 91 and the back surface 92) of the printing medium 9, and the inspection part 42 of the control unit 4 (see FIG. 3) acquires the page identification results for both sides from the output of the image capturing part 6.

Then, for each of the front surface 91 and the back surface 92 of the printing medium 9, as in the first embodiment, the page identification result for each page is compared with the page identification information 432 (see FIG. 3) included in the print data 431 of the page stored in the storage part 43 of the control unit 4, and a printing defect is detected if the page identification result and the page identification information 432 are different.

With the printing apparatus 1*a*, as in the first embodiment, a printing defect can be quickly detected during inspection of the first page in which the printing defect has occurred, irrespective of with which ink color out of the plurality of colors used in the printing apparatus 1*a* the printing defect has occurred. It is also possible to easily specify the color of an ink with which a printing defect has occurred.

With the printing apparatus 1*a* according to the third embodiment, it is in particular possible to easily inspect consistency in printing between the front surface 91 and the back surface 92 of each page (i.e., whether or not the content printed on the front surface 91 of a single page of the printing medium 9 corresponds to the content printed on the back surface 92 of that page), by comparing a combination of the page identification result acquired from the image capturing result of the front surface 91 of each page and the page identification result acquired from the image capturing result of the back surface 92 of that page with a combination of the page identification information 432 included in the print data 431 of the front surface 91 of the page and the page identification information 432 included in the print data 431 of the back surface 92 of the page.

While the above has been a description of embodiments of the present invention, the present invention is not intended to be limited to the above-described embodiments, and various modifications are possible.

The page identifiers described above and shown in FIGS. 5 through 8 are preferable examples, and the relationship between the shape of the page identifier and the numerical value indicated by the page identifier may be appropriately changed in accordance with the content to be printed on the printing medium 9 or the like. Furthermore, various types of information (e.g., character information) other than numerical values may be indicated by a page identifier or single-color parts included in a page identifier.

The page identifier 95 or the bar code 96 does not necessarily have to be printed with either inks of all of the plurality of colors used in the printing apparatus or only an ink of any one of these colors, and it may be printed with, for example, inks of an arbitrary number of colors, which is at least two, out of the above plurality of colors, so as to include single-color parts, the number of which is equal to the arbitrary number of colors. In other words, the page identifier 95 or the bar code 96 includes at least one single-color part printed with any one of the plurality of colors used in the printing apparatus. Then, by printing single-color parts with all of the plurality of colors during the period in which printing is being performed for the unit page number, it is possible to detect printing defects due to inks of all of the colors in inkjet color printing.

In the printing apparatuses according to the above-described embodiments, for example, instead of moving the printing medium 9 with the scanning mechanism 27, the printing medium 9 may be fixed and the ejection unit 3 and the image capturing part 6 (and also the ejection unit 3*a*) may be moved in the scanning direction. In other words, it is sufficient that the scanning mechanism 27 causes the printing medium 9 to move in the scanning direction relative to the ejection unit 3 and the image capturing part 6 (and also the ejection unit 3*a*).

The configuration of the printing apparatus 1 may be applied to a printing apparatus in which an ejection unit moves back and forth in a direction perpendicular to a scanning direction and a printing medium 9 is moved by a predetermined distance in the scanning direction for each single unidirectional movement of the ejection unit (so-called shuttle printing is performed). Furthermore, the printing apparatus 1 may perform, for example, sheet-fed printing in which printing is sequentially performed on a plurality of printing media that do not have a long length.

While the invention has been shown and described in detail, the foregoing description is in all aspects illustrative and not restrictive. It is therefore understood that numerous modifications and variations can be devised without departing from the scope of the invention.

DESCRIPTION OF REFERENCE SIGNS

1, 1*a* Printing apparatus
6 Image capturing part
9 Printing medium
11 Printing mechanism
41 Print control part
42 Inspection part
91 Front surface
92 Back surface
93 Page
95, 95*a* Page identifier
96 Bar code
272 Supply part
273 Taking-up part
431 Pint data
432 Page identification information
951*a*-951*d* Single-color part

The invention claimed is:

1. A printing apparatus comprising:

a printing mechanism by which printing is performed on a printing medium with inks of a plurality of colors using an inkjet system;

a print control part that, when each page of said printing medium is printed, prints a page identifier on said printing medium based on page identification information included in print data of said each page, by controlling said printing mechanism;

an image pickup part that captures an image of said page identifier; and an inspection part that detects a printing defect by acquiring a page identification result from an output of said image pickup part and comparing said page identification result with said page identification information, wherein said page identifier includes a plurality of single-color parts each having a shape representing a respective one of single-digit integers from "0" to "9", said plurality of single-color parts are printed respectively in a plurality of single-color-part printing areas, said plurality of single-color-part printing areas and a plurality of blank areas on which printing is not performed being alternately arranged, under control of said print control part, said page identifier on said each page is printed with only one of said plurality of colors, and printing of a plurality of single-color parts with all of said plurality of colors is performed during a period in which printing is being performed on only a predetermined number of pages.

2. The printing apparatus according to claim 1, wherein a color of said page identifier is sequentially changed for each page.

3. The printing apparatus according to claim 2, wherein said page identifier on said each page is a bar code.

4. The printing apparatus according to claim 2, wherein said printing mechanism performs printing on both sides of said printing medium, in which case said page identifier is printed on said both sides, said image pickup part captures images of said page identifiers on said both sides, and said inspection part inspects consistency in printing between said both sides by acquiring page identification results for said both sides from an output of said image pickup part.

5. The printing apparatus according to claim 2, wherein said printing mechanism comprises:

a supply part that holds a roll of unprinted printing medium and lets said printing medium out from said roll; and a taking-up part that takes up a portion of said printing medium that has undergone printing.

6. The printing apparatus according to claim 1, wherein said page identifier on said each page is a bar code.

7. The printing apparatus according to claim 1, wherein said printing mechanism performs printing on both sides of said printing medium, in which case said page identifier is printed on said both sides, said image pickup part captures images of said page identifiers on said both sides, and said inspection part inspects consistency in printing between said both sides by acquiring page identification results for said both sides from an output of said image pickup part.

8. The printing apparatus according to claim 1, wherein said printing mechanism comprises:

a supply part that holds a roll of unprinted printing medium and lets said printing medium out from said roll; and a taking-up part that takes up a portion of said printing medium that has undergone printing.

9. A printing apparatus comprising:

a printing mechanism by which printing is performed on a printing medium with inks of a plurality of colors using an inkjet system;

a print control part that, when each page of said printing medium is printed, prints a page identifier on said printing medium based on page identification information included in print data of said each page, by controlling said printing mechanism;

an image pickup part that captures an image of said page identifier; and an inspection part that detects a printing defect by acquiring a page identification result from an output of said image pickup part and comparing said page identification result with said page identification information, wherein said page identifier includes a plurality of single-color parts each having a shape representing a respective one of single-digit integers from "0" to "9", each of said plurality of single-color parts being printed with only one of said plurality of colors, said plurality of single-color parts are printed respectively in a plurality of single-color-part printing areas, said plurality of single-color-part printing areas and a plurality of blank areas on which printing is not performed being alternately arranged, said page identifier on said each page includes a plurality of single-color parts printed with all of said plurality of colors.

10. The printing apparatus according to claim 9, wherein said inspection part acquires a page identification result from each of said single-color parts printed with said plurality of colors and compares each of said page identification results with said page identification information.

11. The printing apparatus according to claim 10, wherein said page identifier on said each page is a bar code.

12. The printing apparatus according to claim 10, wherein said printing mechanism performs printing on both sides of said printing medium, in which case said page identifier is printed on said both sides, said image pickup part captures images of said page identifiers on said both sides, and said inspection part inspects consistency in printing between said both sides by acquiring page identification results for said both sides from an output of said image pickup part.

13. The printing apparatus according to claim 10, wherein said printing mechanism comprises:

a supply part that holds a roll of unprinted printing medium and lets said printing medium out from said roll; and a taking-up part that takes up a portion of said printing medium that has undergone printing.

14. The printing apparatus according to claim 9, wherein said page identifier on said each page is a bar code.

15. The printing apparatus according to claim 9, wherein said printing mechanism performs printing on both sides of said printing medium, in which case said page identifier is printed on said both sides, said image pickup part captures images of said page identifiers on said both sides, and said inspection part inspects consistency in printing between said both sides by acquiring page identification results for said both sides from an output of said image pickup part.

16. The printing apparatus according to claim 9, wherein said printing mechanism comprises:

a supply part that holds a roll of unprinted printing medium and lets said printing medium out from said roll; and a taking-up part that takes up a portion of said printing medium that has undergone printing.

* * * * *